US005588370A

United States Patent [19]

Longley

[11] Patent Number: 5,588,370

[45] Date of Patent: Dec. 31, 1996

[54] RIGID SHELF STRUCTURE

[76] Inventor: Jonathan T. Longley, 15 Westwood Rd., Lexington, Mass. 02173

[21] Appl. No.: 415,732

[22] Filed: Apr. 3, 1995

[51] Int. Cl.[6] ..... A47B 23/00

[52] U.S. Cl. ..... 108/42; 211/90

[58] Field of Search ..... 108/42, 91, 92, 108/25; 211/153, 135, 73, 90; 248/220.1, 220.2

[56] References Cited

U.S. PATENT DOCUMENTS

| | | | |
|---|---|---|---|
| 975,619 | 11/1910 | Hollander | 108/42 |
| 1,599,654 | 9/1926 | Cranston | 211/153 |
| 2,389,349 | 11/1945 | Eastman | 108/42 |
| 2,657,811 | 11/1953 | Isler | 108/42 |
| 3,008,585 | 11/1961 | McNeill | 108/42 |
| 3,033,376 | 5/1962 | Eastman | 108/42 |
| 3,906,872 | 10/1975 | Erickson . | |
| 4,132,178 | 1/1979 | Mueller et al. . | |
| 4,244,301 | 1/1981 | Nakatsu . | |
| 4,365,562 | 12/1982 | Webb . | |
| 4,535,898 | 8/1985 | Jones et al. | 211/153 |
| 4,555,082 | 11/1985 | Sack et al. | 108/42 X |
| 4,723,492 | 11/1988 | Salvatini | 108/42 |
| 4,727,815 | 3/1988 | Miller | 108/42 |
| 4,970,907 | 10/1989 | McKee | 108/42 |

FOREIGN PATENT DOCUMENTS

| | | | |
|---|---|---|---|
| 558198 | 3/1960 | Belgium | 108/42 |

*Primary Examiner*—José V. Chen
*Attorney, Agent, or Firm*—Joseph Stecewycz

[57] ABSTRACT

A corner shelving structure comprising an upper surface, abutment surfaces, and a front face, adapted for use with an adhesive or with mechanical fasteners, and comprising a torsion member which is integral with the upper surface and extends between the front face and at least one abutment surface.

17 Claims, 6 Drawing Sheets

RIGID SHELF STRUCTURE

BACKGROUND OF THE INVENTION

1. Field of the Invention

The present invention relates to cantilever shelf structures and, more particularly, is directed to corner shelves suitable for mounting with an adhesive.

2. Description of the Prior Art

The present art discloses various configurations of cantilever shelf structures intended for mounting in a corner.

One popular configuration, which provides attachment at a shelf corner, also allows for vertical adjustment of the shelf. This configuration is exemplified by U.S. Pat. No. 4,132,178 to Mueller et al. which discloses a shelf and corner post combination. The post includes a series of vertically-spaced indentations so as to enable the positioning of the shelf into any of a variety of selected elevations. The shelf is supported at the corner which engages the corner post.

U.S. Pat. No. 4,365,562 to Webb similarly discloses a support assembly for an inside corner formed by a vertical rear wall and a vertical side wall, the walls intersecting each other at a right angle. A single vertical track and a structural member engaging the track provide positioning support for a shelf. Because the loading on the shelf configurations taught by Mueller et al. and by Webb is borne at only one shelf corner, they lend themselves to the support of light to moderate loads.

Another popular configuration utilizes external structural supporting members to provide additional supportive capability. This configuration is exemplified by U.S. Pat. No. 3,906,872 to Erickson which discloses a knock-down corner shelf structure having three rigid interconnected uprights forming a pyramidal structure. Transverse support for the shelf forward portions is provided by shelf support rods which interconnect the two forward uprights.

U.S. Pat. No. 4,244,301 to Nakatsu discloses a corner shelf assembly which also uses external structural supporting members. The external members consist of flexible lines depending from a support hook so as to allow the rearrangement of shelves or the removal of the entire assembly. As can be seen, the two configurations taught by Erickson and by Nakatsu are adapted for the support of more moderate loads by the incorporation of the external structural supporting members.

In applications where a external structural members would be undesirable or obtrusive, a corner shelf assembly such as that disclosed by U.S. Pat. No. 4,727,815 to Miller may be preferable. This configuration uses a bracket to engage one corner of the shelf and allows the abutting surfaces of the shelf to make direct contact with intersecting vertical mounting surfaces. The design is adapted for use in bathroom wall areas and allows for caulking to completely surround the shelf so as to prevent the passage of water through any holes which may have been drilled into the wall tiles.

The prior art does not appear to have provided for a corner shelf configuration, suitable for mounting with an adhesive, which can be used to support moderate to heavy loads without the need for external structural members. As is generally known in the art, the load safely supportable by a non-rigid shelf unit secured by an adhesive is limited because the loading forces tend to distort and flex the shelf and, thus, to urge the shelf abutting surfaces away from the support surfaces. The adhesive layer is placed in tension and may fail. In alternative failure mode, the load is not uniformly distributed along the shelf abutting surfaces. This causes some regions of the adhesive layer to be placed under greater stress, and the highest-stressed regions become the first to experience failure. Consequently, the full shear strength of the entire adhesive layer cannot be utilized.

It is therefore an object of the present invention to provide a shelf structure which does not suffer from the heretofore-mentioned disadvantages and limitations.

It is a further object of the present invention to provide such a shelf structure which is suitable for mounting with an adhesive and, optionally, with mechanical fasteners.

It is a further object of the present invention to provide such a shelf structure which utilizes no external structural supporting members.

It is a further object of the invention to provide such a shelf structure which fully utilizes the properties of a mounting adhesive.

It is a still further object of the invention to provide such a shelving structure which support additional load when attached by nonadhesive means or in conjunction with multiple attachments.

Other objects of the present invention will in part be obvious and will in part appear hereinafter.

The invention accordingly comprises the apparatuses, processes and products, together with their elements and interrelationships, that are exemplified in the following disclosure, the scope of which will be indicated in the appended claims.

SUMMARY OF THE INVENTION

The present invention results from the observation that incorporating a torsion member into a cantilever shelf structure will increase the stiffness and rigidity of the shelf sufficiently to enable efficient use of a mounting adhesive, and will allow moderate to heavy loads to be supported by the shelf. The increased stiffness serves to minimize distortion to the shelf structure and thus helps to prevent a loading configuration which results in forces unevenly applied to a mounting adhesive. In addition, the increased shelf stiffness serves to more efficiently transfer shelf loads to mounting interface when mechanical fasteners are utilized.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
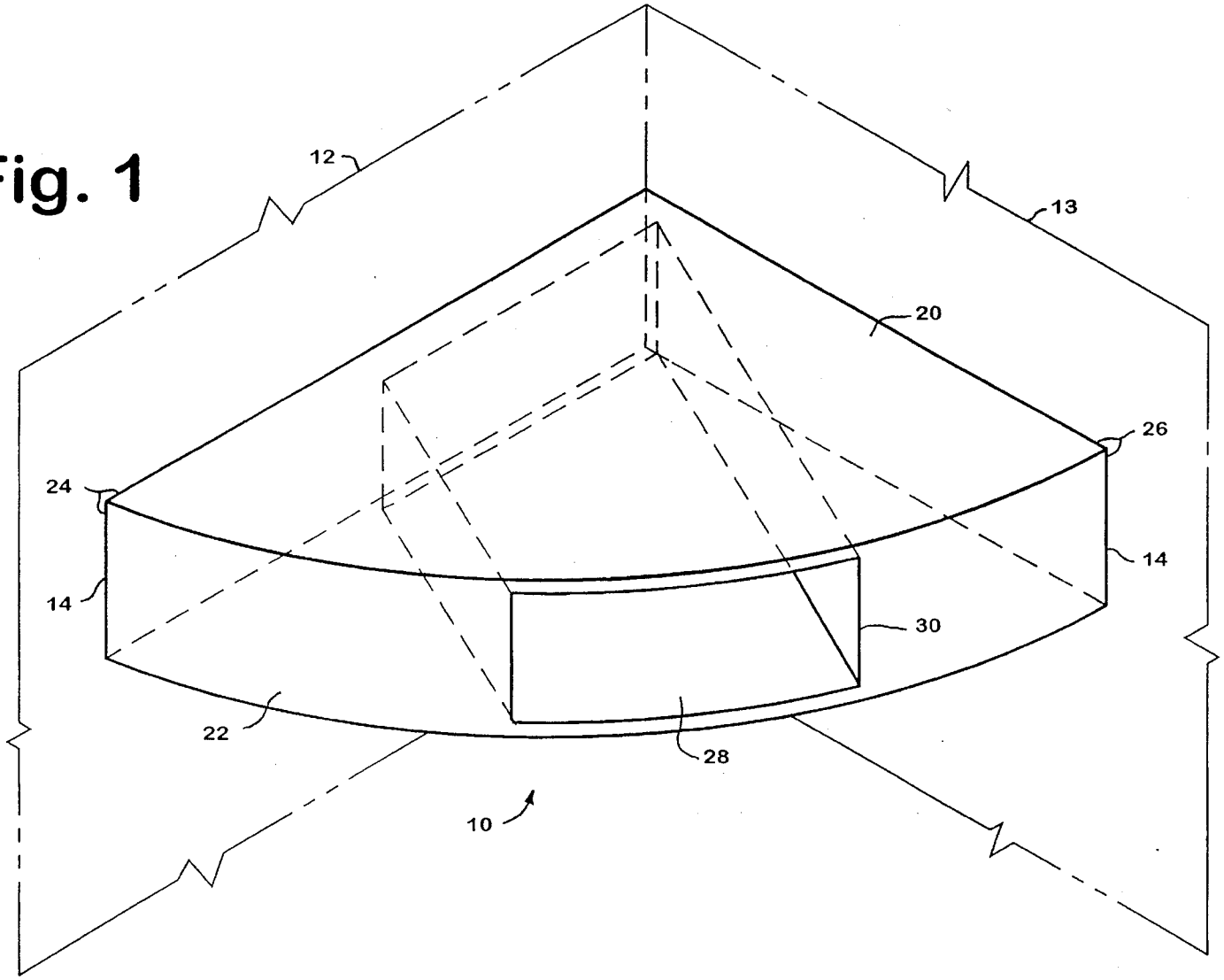
FIG. 1 is a diagrammatic isometric view of one embodiment of a shelf structure having a convex front face and constructed in accordance with the present invention.

FIG. 1 is a diagrammatic isometric view of a shelf 10 constructed in accordance with the present invention. Shelf 10, which can be used to support a load, such as displayed or stored objects, is shown installed in an interior corner which is defined by adjoining mounting surfaces 12 and 13. Mounting surfaces 12 and 13 are here shown intersecting at a right angle to each other, with shelf 10 generally perpendicular to both mounting surfaces 12 and 13. Shelf 10 is advantageously adapted for mounting when there are provided two mounting surfaces defining a dihedral angle. It is not a requirement that both mounting surfaces meet and form a closed corner. Additionally, shelf 10 may meet either mounting surface at another angle to accommodate a different application.

Installation is accomplished by securing shelf 10 to mounting surfaces 12 and 13 either by mechanical fastening, or by adhesive means, or a by combination of both adhesive and fasteners. As is well known in the art, a vertical load applied to a generally horizontal shelf 10 will appear as shear forces on mounting surfaces 12 and 13.

In the embodiment shown, adhesive-coated backing strips 14, have been placed between mounting surface 12 and a first abutment surface 24 and between mounting surface 13 and a second abutment surface 26. In a typical application, mounting surfaces 12 and 13 contain minor imperfections, or do not precisely align with abutment surfaces 24 and 26, with the result that gaps can form between shelf 10 and surfaces 12 and 13 when shelf 10 is positioned for installation. In such cases, backing strip 14 can be made of a thick, substantially pliable material so as to minimize or eliminate gaps between shelf 10 and mounting surfaces 12 and 13.

Shelf 10 includes an upper surface 20 which extends between abutment surfaces 24 and 26, and is bordered by a front face 22. Front face 22 may be convex, as shown, in order to provide an extended loading surface. Alternatively the front face can be another shape as the decor of a particular application may require. Shelf 10 also includes an integral torsion member 30, described in more detail below, which serves to increase the rigidity of shelf 10.

This increased rigidity provides at least two important benefits. First, the rigidity of shelf 10 helps to insure that the applied load is fairly evenly distributed to abutment surfaces 24 and 26 and, therefore, to mounting surfaces 12 and 13 through backing strips 14, or through mechanical fasteners when used. With a less rigid shelf, the applied load is not as evenly distributed and the securing means is more likely to develop regions of high stress and, consequently, to fail.

Secondly, an applied load is less likely to cause shelf 10 to flex than is a comparable shelf having no torsion member. As a less rigid shelf flexes in response to an applied load, there may be developed tensile forces which act to pull portions of the abutment surfaces away from mating mounting surfaces. This action tends to cause a mounting adhesive to yield, under tension, in loading circumstances where the adhesive would not be likely to fail under shear.

Shelf 10, as shown, can be fabricated as an integral unit by means of injection molding, or by some other comparable process. To enable fabrication as an integral unit, there may be provided a front face opening 28 by which torsion member 30 is formed. In a typical application, shelf 10 may provide additional storage capacity by means of front face opening 28.

Figure 2:
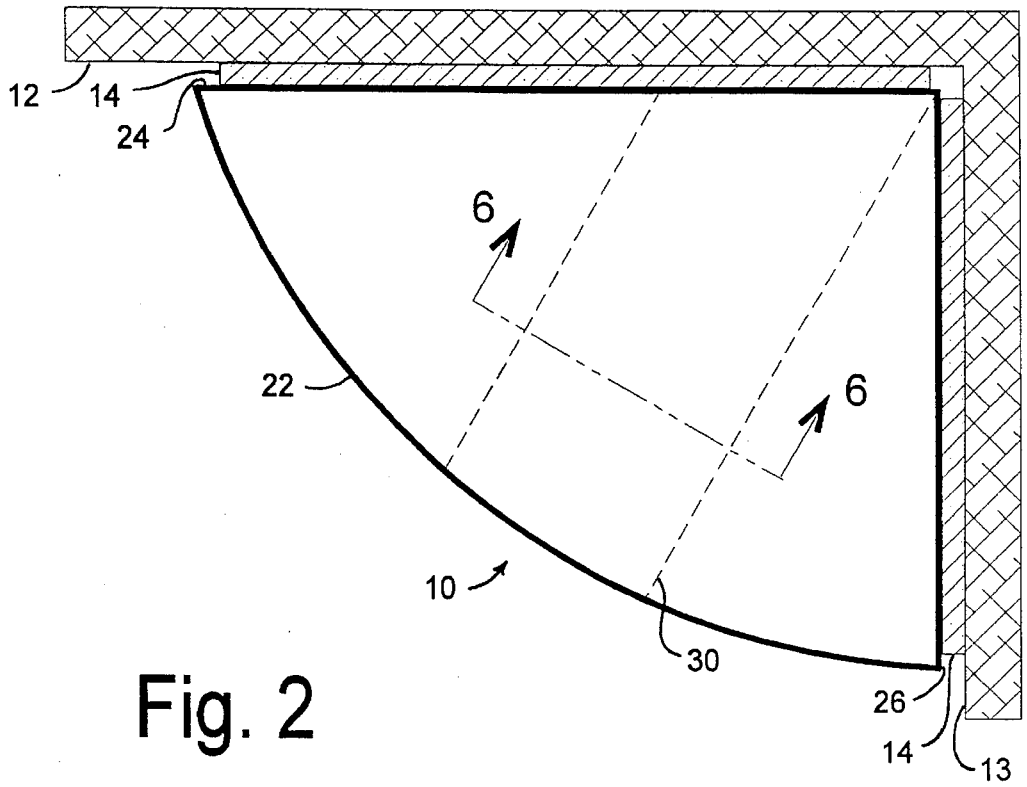
FIG. 2 is a plan view of the shelf structure of FIG. 1 showing, by means of dashed lines, a preferred orientation of an integral torsion member.
Figure 3:
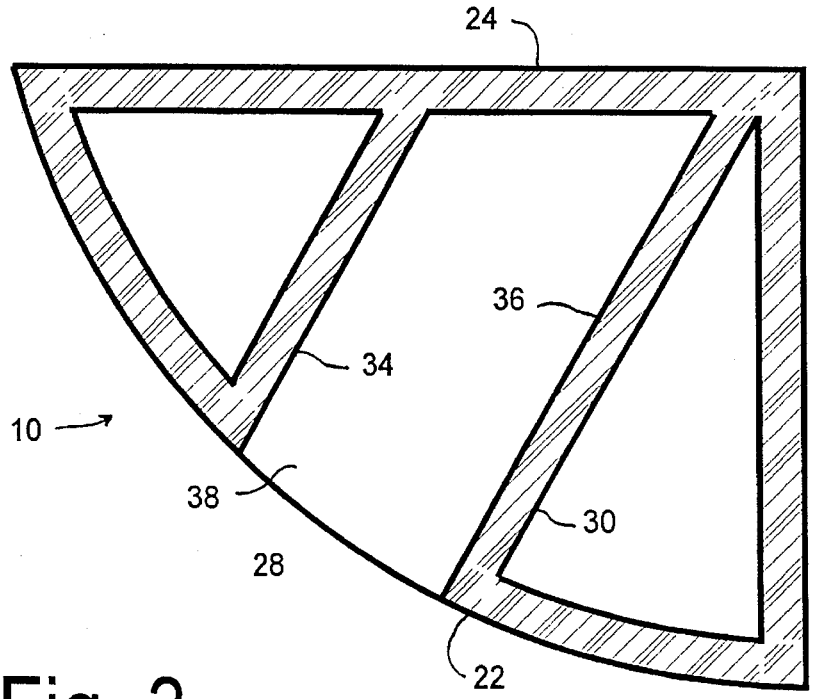
FIG. 3 is a sectional plan views of the shelf structure of FIG. 2, showing the integral torsion member in longitudinal section forming an opening at the convex front face.

FIG. 2 is a top view of shelf 10 showing placement of backing strips 14 between mounting surface 12 and first abutment surface 24, and between mounting surface 13 and second abutment surface 26. Torsion member 30, which extends from front face 22 to first abutment surface 24, is more clearly shown in FIG. 3, which is a top view of shelf 10 with upper surface 20 omitted. Torsion member 30 includes a first side wall 34, a second side wall 36, and a lower member 38. First side wall 34, second side wall 36, and lower member 38 extend between front face 22 and first abutment surface 24.

Figure 4:
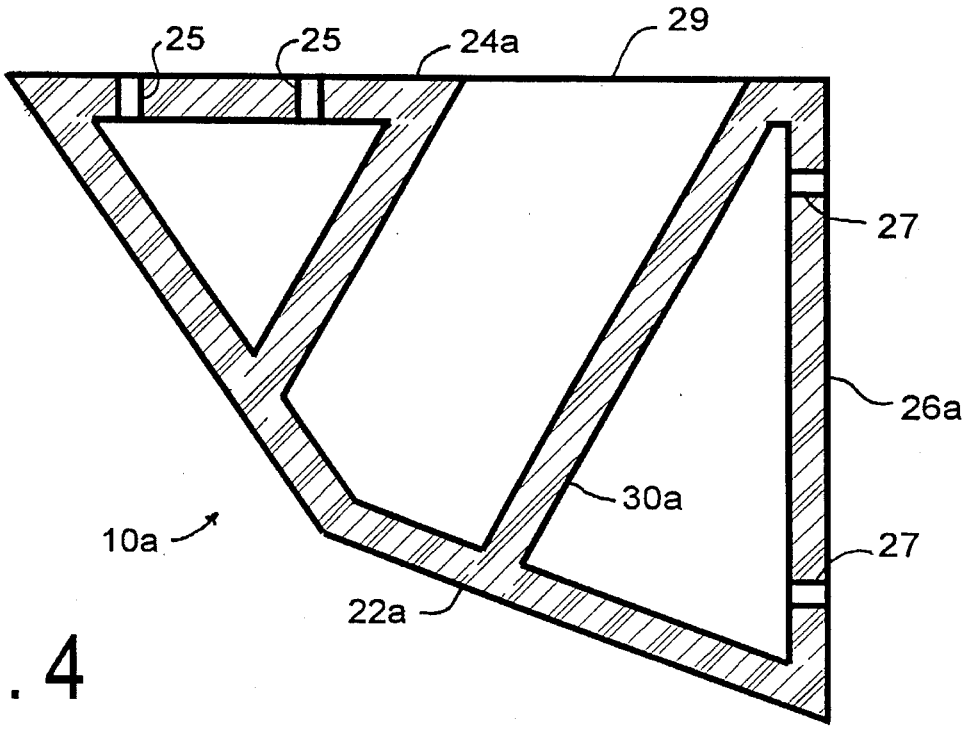
FIG. 4 is a sectional plan views of an alternative embodiment of the shelf structure constructed in accordance with the present invention, showing an integral torsion member forming an opening at a rearward abutment surface and a front face having a dihedral surface.

Torsion member 30 may be closed at first abutment surface 24 to form the configuration shown, but the invention can be practiced with various alternative configurations. FIG. 4 shows one such alternative embodiment. A shelf **10*a* includes a torsion member 30*a* having a rear opening 29 at a first abutment surface 24*a*. Torsion member 30*a* is closed at a front face 22*a* which has the shape of a dihedral surface. This configuration may be used where a more unobtrusive appearance is desired. Shelf 10*a* also includes a pair of through holes 25 in a first abutment surface 24*a* and a pair of through holes 27 in a second abutment surface 26*a*. Through holes 25 and 27 are provided for mechanical fasteners which can be used alone, or with adhesive strips, to mount shelf 10*a***.

Figure 5:
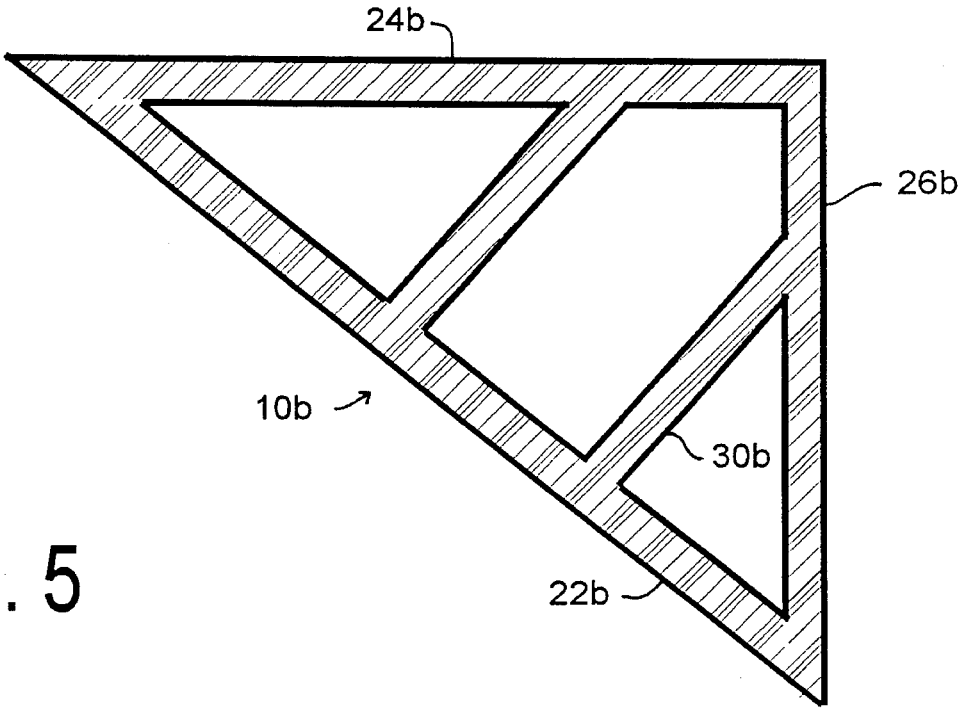
FIG. 5 is a sectional plan views of yet another embodiment of the shelf structure constructed in accordance with the present invention, showing an integral torsion member closed at both ends and a flat front face.

By using appropriate fabrication methods, a shelf **10*b* can be formed having a torsion member 30*b* with closed ends, as shown in FIG. 5. Torsion member 30*b* is here shown extending between a front face 22*b* to both a first abutment surface 24*b* and to a second abutment surface 26*b*. Front face 22*b*** is here shown as a flat surface, but can be convex or another shape as the particular application may require.

Figure 6:
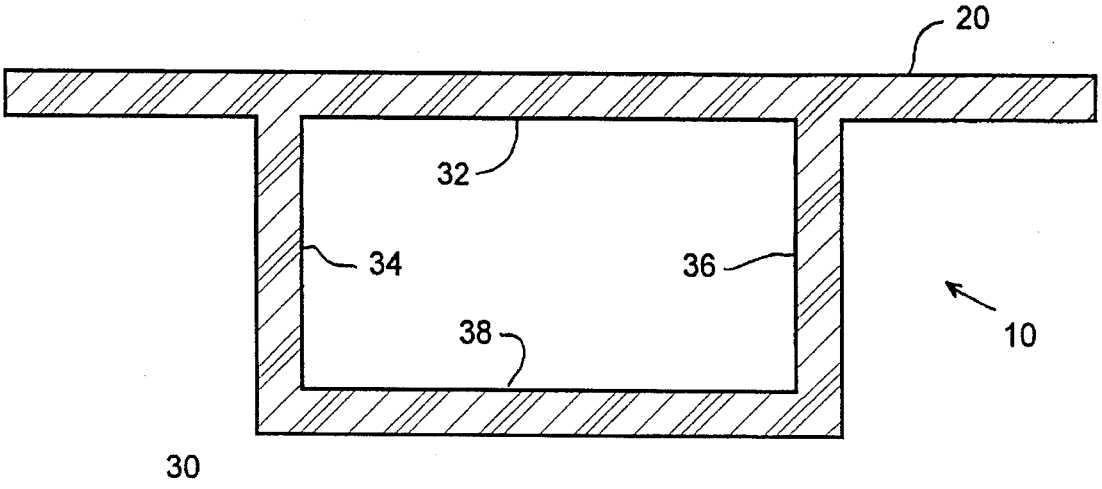
FIG. 6 is a cross-sectional view of the a shelf structure constructed in accordance with the present invention, showing an integral torsion member forming a closed rectangular section, the view corresponding to the section lines indicated in FIG. 1.

FIG. 6 is a cross-sectional view of shelf 10 taken as shown in FIG. 2. In a preferred embodiment, torsion member 30 forms a closed rectangular section comprising an upper member 32, lower member 38, first side wall 34, and second side wall 36. Upper member 32 is formed as a unit with upper surface 20. In an alternative embodiment, torsion member 30 can form a closed section of another shape as described below. Similarly, the cross-sectional shape of torsion members 30*a* and 30*b*, shown in FIGS. 4 and 5 respectively, can be a closed rectangular section, as in FIG. 6, or an alternative cross section as described below.

Figure 7:
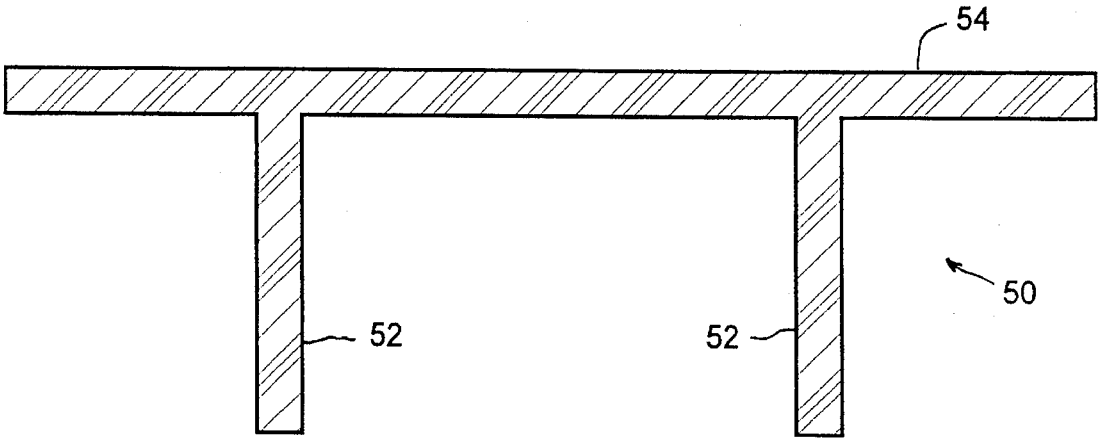
Fig. 7 Prior Art
FIG. 7 is a cross-sectional view of a prior-art shelf.

In contrast to the disclosed shelf configuration comprising a closed section, the cross section of a conventional shelf configuration may comprise an open section, as exemplified by a prior-art shelf 50 shown in FIG. 7. Shelf 50 incorporates ribs, or stiffeners 52, to decrease the flexing of a loading surface 54 along the longitudinal axes of the stiffeners. Stiffeners 52 form an open section together with loading surface 54. When shelf 50 is subjected to an applied load, loading surface 54 will flex in the region between stiffeners 52 because the unattached edges of stiffeners 52 are free to move relative to one another. This flexing of loading surface 54 results in the uneven distribution of loading forces to abutment surfaces, as described above.

As is well-known in the art, the rigidity of an open section is much smaller than the rigidity of a similar closed section. Consequently, by integrating a closed section into a shelf structure to form one-piece unit as described above the rigidity of the shelf is increased because the closed section is able to withstand a much higher torsional load than is a similar open section. In an example provided in the textual reference *Aircraft Structures* by David J. Peery, at pp. 332–33, a closed tube was calculated to have approximately 1200 times the torsional stiffness of a similar tube which was slit along its length.

Figure 8:
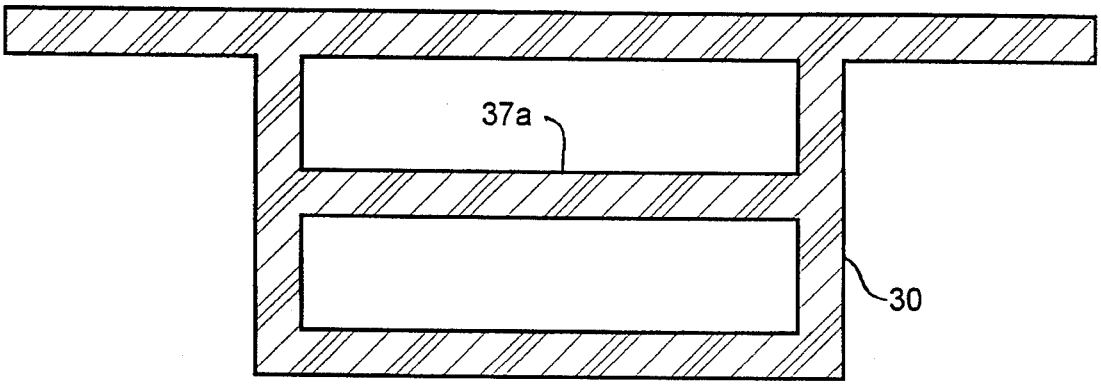
FIG. 8 is a cross sectional view of an alternative embodiment of the torsion member of FIG. 6, showing an additional horizontal member incorporated into the torsion member.
Figure 9:
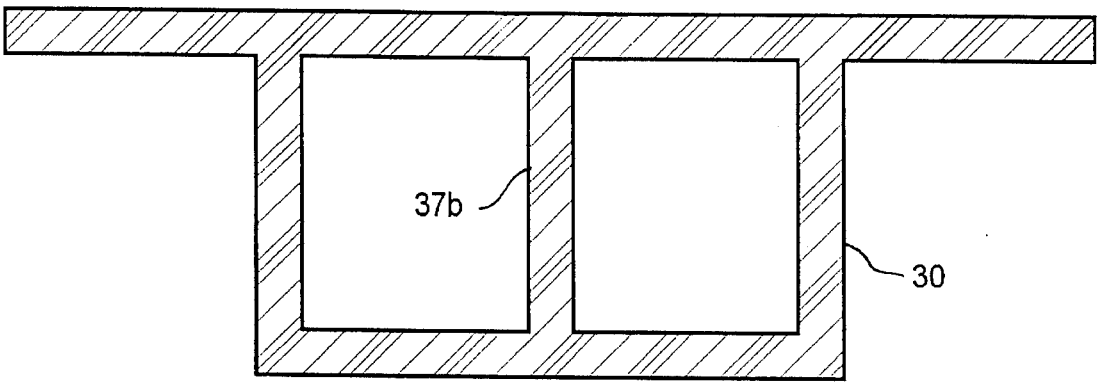
FIG. 9 is a cross sectional view of yet another embodiment of the torsion member of FIG. 6, showing an additional vertical member incorporated into the torsion member.

In an alternative embodiment, torsion member 30 may include a horizontal dividing member 37*a*, shown in FIG. 8, or a vertical dividing member 37*b*, shown in FIG. 9. Integration of either member into torsion member 30 provides an even greater degree of rigidity to the shelf, and the dividing feature can be used to modify the shelf storage area when the shelf includes front face opening 28, as shown in FIG. 1.

Figure 10:
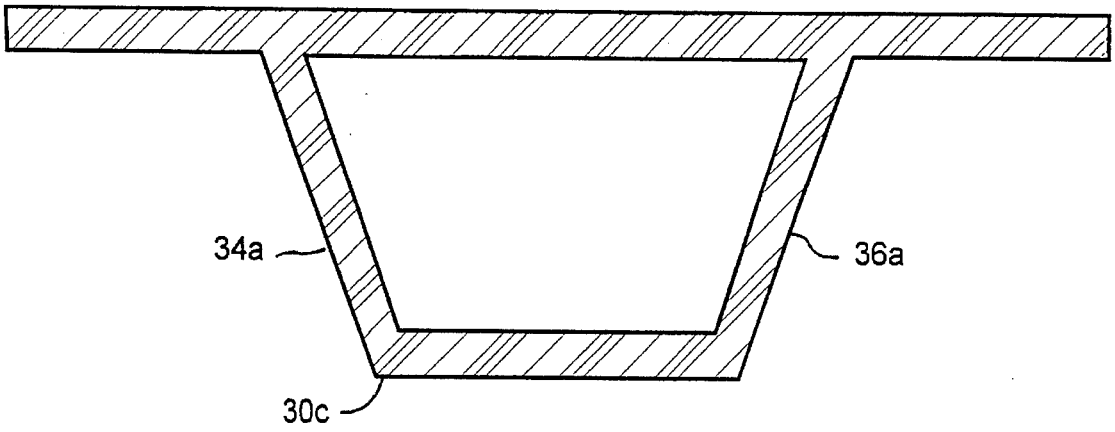
FIG. 10 is a cross sectional view of an alternative embodiment of the shelf structure constructed in accordance with the present invention, showing an integral torsion member forming a closed trapezoidal section.
Figure 11:
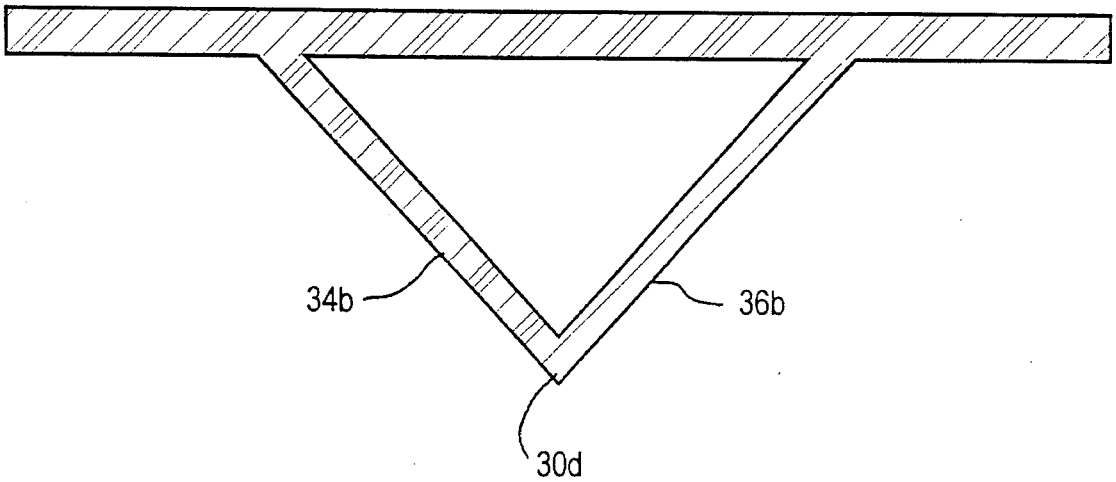
FIG. 11 is a cross sectional view of yet another embodiment of the shelf structure constructed in accordance with the present invention, showing an integral torsion member forming a closed triangular section.

Additionally, is should be understood that the torsion member side walls need not be perpendicular to the upper surface. One alternative torsion member 30*c* can be formed with a first side wall 34*a* and a second side wall 36*a* angled towards one another, as shown in FIG. 10. Another alternative torsion member 30*d* can be formed with a first side wall 34*b* adjoining a second side wall 36*b*, as shown in FIG. 11.

It should be understood that changes may be made in the above construction and in the foregoing sequences of operation without departing from the scope of the invention. It is accordingly intended that all matter contained within the above description or shown in the accompanying drawings be interpreted in an illustrative, rather than in a limiting, sense.

It should also be understood that the following claims are intended to cover all of the generic and specific features of the invention as described herein, and all statements of the scope of the invention which, as a matter of language, might be said to fall therebetween.

What is claimed is:

1. A shelf structure, suitable for mounting in a corner, comprising:

an upper surface;

a first abutment surface depending from said upper surface;

a second abutment surface depending from said upper surface, said second abutment surface further conjoined to said first abutment surface;

a front face depending from said upper surface, said front face further extending between said abutment surfaces; and a torsion member unitary with said upper surface, said torsion member extending between said front face and at least one of said abutment surfaces.

2. A shelf structure as in claim 1 further comprising at least one adhesive-coated backing strip affixed to at least one abutment surface such that said shelf structure can be secured to a mounting surface by means of said backing strip.

3. A shelf structure as in claim 1 further comprising at least one through hole in each of said abutment surfaces such that said shelf structure can be secured to a mounting surface by means of mechanical fasteners.

4. A shelf structure as in claim 1 wherein said torsion member comprises at least three sides such that the cross section of said torsion member forms a closed polygon.

5. A shelf structure as in claim 4 further comprising an opening in said front face, said opening generally corresponding to said cross sectional shape of said torsion member.

6. A shelf structure as in claim 5 further comprising a dividing member extending between two said sides of said torsion member.

7. A shelf structure as in claim 4 further comprising an opening in at least one of said abutment surfaces, said opening generally conforming to the said cross sectional shape of said torsion member.

8. A shelf structure as in claim 4 wherein said closed polygon is a rectangle.

9. A shelf structure as in claim 4 wherein said closed polygon is a trapezoid.

10. A shelf structure as in claim 4 wherein said closed polygon is a triangle.

11. A shelf structure, suitable for mounting in a corner, comprising:

an upper surface;

a first abutment surface depending from said upper surface;

a second abutment surface depending from said upper surface, said second abutment surface further conjoined to said first abutment surface;

a front face depending from said upper surface, said front face further extending between said abutment surfaces; and a torsion member extending between said front face and at least one of said abutment surfaces, said torsion member comprising a closed section, said closed section comprising a first side wall, a second-side wall, a lower member, and an upper member, said upper member unitary with said upper surface, said side walls extending from said upper surface, and said side walls further extending between at least one of said abutment surfaces and said front face.

12. A shelf structure as in claim 11 further comprising at least one adhesive-coated backing strip affixed to at least one abutment surface such that said shelf structure can be secured to a mounting surface by means of said backing strip.

13. A shelf structure as in claim 12 further comprising at least one through hole in each of said abutment surfaces such that said shelf structure can additionally be secured to the mounting surface by means of mechanical fasteners.

14. A shelf structure as in claim 11 further comprising an opening in said front face, said opening generally corresponding to said cross sectional shape of said torsion member.

15. A shelf structure as in claim 14 further comprising a dividing member extending between two said side walls.

16. A shelf structure as in claim 14 further comprising a dividing member extending between said upper member and lower member.

17. A shelf structure, suitable for mounting in a corner, comprising:

an upper surface;

a first abutment surface depending from said upper surface;

a second abutment surface depending from said upper surface, said second abutment surface further conjoined to said first abutment surface;

a front face depending from said upper surface, said front face further extending between said abutment surfaces;

a torsion member extending between said front face and at least one of said abutment surfaces, said torsion member comprising a closed section, said closed section comprising a first side wall, a second side wall, a lower member, and an upper member, said upper member unitary with said upper surface, said side walls extending from said upper surface, and said side walls further extending between at least one of said abutment surfaces and said front face;

said front face comprising an opening generally conforming to the cross section of said torsion member; and a dividing member extending between said side walls.

* * * * *